US006305031B1

(12) United States Patent
White

(10) Patent No.: US 6,305,031 B1
(45) Date of Patent: Oct. 23, 2001

(54) PROTECTIVE APPLIANCE

(75) Inventor: Anthony John White, Cheshire (GB)

(73) Assignee: Armadillo Sports Design Limited, Knutsford (GB)

( * ) Notice: Subject to any disclaimer, the term of this patent is extended or adjusted under 35 U.S.C. 154(b) by 0 days.

(21) Appl. No.: 09/522,358

(22) Filed: Mar. 9, 2000

(30) Foreign Application Priority Data

Jun. 12, 1998 (GB) ..... 9812600

(51) Int. Cl.[7] ..... A41D 13/00

(52) U.S. Cl. ..... 2/455; 2/22; 2/463; 2/464; 2/465; 2/467; 128/882; 602/61

(58) Field of Search ..... 2/455, 463–467, 2/2.5, 16, 22, 24, 242, 911, 239–241, 302; 128/878, 881, 882; 602/18–20, 23, 61, 62, 63

(56) References Cited

U.S. PATENT DOCUMENTS 3,787,892 * 1/1974 Quinn ..... 2/455
4,692,946 * 9/1987 Jurga ..... 2/22
4,868,926 * 9/1989 Lowson ..... 2/22
5,107,823 * 4/1992 Fratesi ..... 602/16
5,140,995 * 8/1992 Uhl ..... 128/846
5,477,558 * 12/1995 Volker et al. ..... 2/455
5,507,720 * 4/1996 Lampropoulos ..... 602/27
5,634,211 * 6/1997 Chen ..... 2/22
5,768,717 * 6/1998 Le Sueur ..... 2/467
5,806,092 * 9/1998 Shikatani ..... 2/22
5,898,939 * 5/1999 Schramm ..... 2/22
6,098,208 * 8/2000 Carden ..... 2/455

* cited by examiner

*Primary Examiner*—John J. Calvert
*Assistant Examiner*—Tejash Patel
(74) *Attorney, Agent, or Firm*—Alfred J. Mangels

(57) ABSTRACT

An appliance for protection against impact and strain injury and comprising an inner flexible web or sleeve (10, 15) adapted to be worn about a part of the body such as the lower leg and to conform closely to the shape thereof, and a series of interconnected outer rigid plates (18) attached to the inner web or sleeve (10, 15) such as to provide impact absorption and distribution whilst permitting relative movement between the plates and maintaining its position in use without restraining the wearer's bodily movement. The device is particularly intended to prevent injuries to sports people.

18 Claims, 10 Drawing Sheets

PROTECTIVE APPLIANCE

THIS INVENTION concerns an appliance for protection against impact and strain injury and is particularly intended to prevent such injuries to sports people.

In certain sports, such as football for example, players are particularly vulnerable to injury of the lower leg including bruised lower shins, swelling of the softer muscle tissue on the inner shin, bruised ankles, abrasions to the calves and rear of the leg and swelling or bruising to the Achilles tendon. Many of these injuries occur as a result of impact but also muscle and tendon strain.

Conventional injury prevention means in general include such as elasticated sleeves adapted to be applied over joints or sensitive areas of the body, and devices known as shin pads i.e. one-piece rigid shields which are worn, for example, beneath a football sock. Existing shin-pad designs, whilst effective to a degree, offer a limited level of protection against many of the aforesaid types of injury. One weakness of the standard shin pad is that as a result of a head-on or side-on impact, the pad tends to slip around the lower leg beneath the sock and thus does not provide sufficient impact resistance.

The present invention is concerned with providing a protective appliance which conforms closely to the shape of a body part and which affords adequate impact resistance whilst maintaining its position in use. A further object of the present device is to ensure that the force of an impact is distributed throughout the appliance thus minimising localised bruising.

Commensurate with affording adequate protection, the wearer must retain complete freedom of movement so as not to impair physical performance and also to ensure that muscle injury due to unnatural movement or restraint, does not occur.

According to the present invention, an appliance for protection against impact and strain injury, includes a flexible web or sleeve adapted to be worn about a part of the body and to conform closely to the shape thereof, and a plurality of interconnected rigid plates attached to or adapted to be attached to the web or sleeve such as to permit limited relative movement between the plates.

The web or sleeve may be of continuous tubular form throughout its length, or alternatively, a plurality of longitudinally-spaced straps to be applied about the body to secure the rigid plates, or a panel being part of an item of sports clothing.

Embodiments of the invention will now be described, by way of example only, with reference to the accompanying drawings, in which:

FIGS. 1*a* to 1*c* illustrate respectively in front, rear and side views an inner part of an appliance made in accordance with the invention and worn on the lower leg;

FIGS. 2*a* to 2*c* similarly illustrate an additional feature of the inner part illustrated in FIGS. 1*a* to 1*c;*

FIGS. 3*a* to 3*c* similarly illustrate, as an outer view, the entire appliance when similarly worn;

Figure 1A:
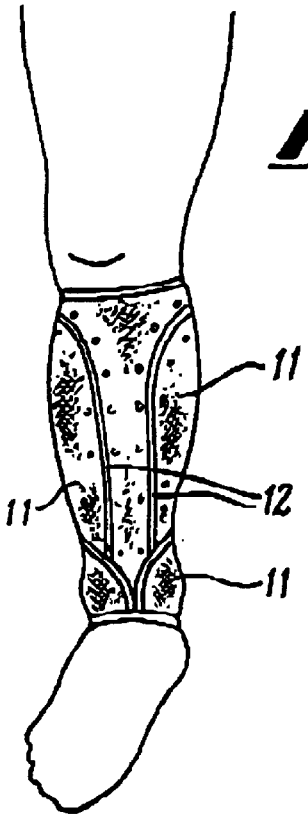

Referring now to the drawings, an appliance made in accordance with the invention for wearing upon the lower leg comprises an inner elasticated sock 10 made from stretch neoprene rather like an elasticated joint protector but which covers the entire lower leg from just below the knee down to around the ankle. The sock 10 is shaped to the natural contour of the leg, hugging the structure of the muscles and the tendons and providing a non-slip base around which the rest of the protective device is created. The material of the sock 10 affords an excellent grip which helps it stay in position whilst at the same time enabling completely free movement of the lower leg.

Figure 1B:
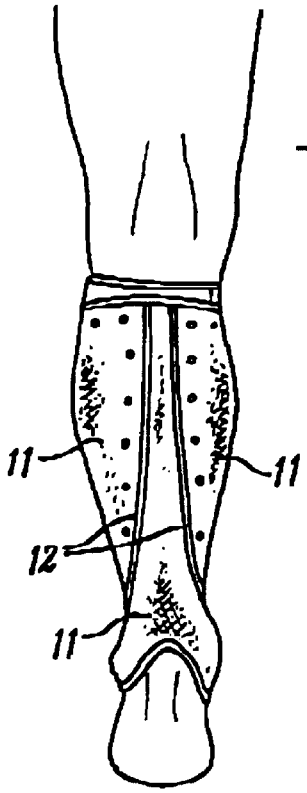
Figure 1C:
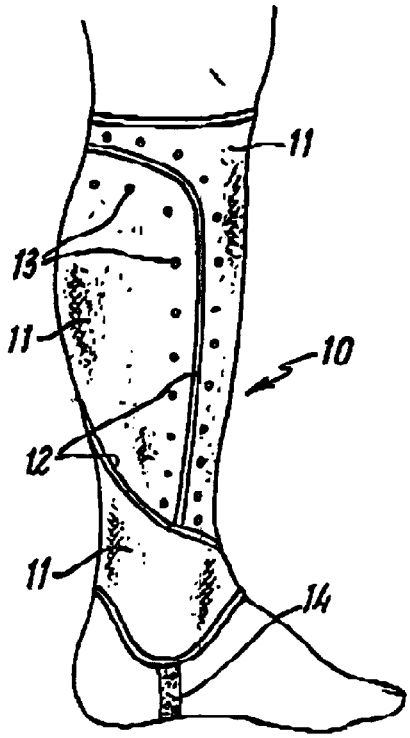

As will be seen from FIGS. 1*a* to 1*c* the sock 10 is preferably constructed from a number of panels 11 shaped to embrace the sides of the calf region and around and over the ankle bones. The panels are stitched together with elasticated strips 12 and the sock is perforated with air holes 13 to enable the skin to "breathe". For enhanced comfort, the sock may be lined internally with a nylon layer, and a stirrup support 14 may be provided which passes under the foot to prevent the sock from riding up on to the knee.

Figure 2A:
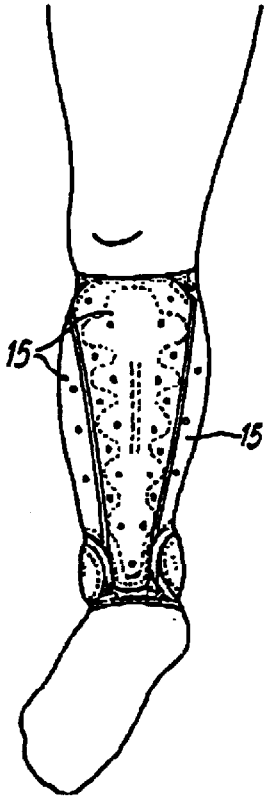
Figure 2B:
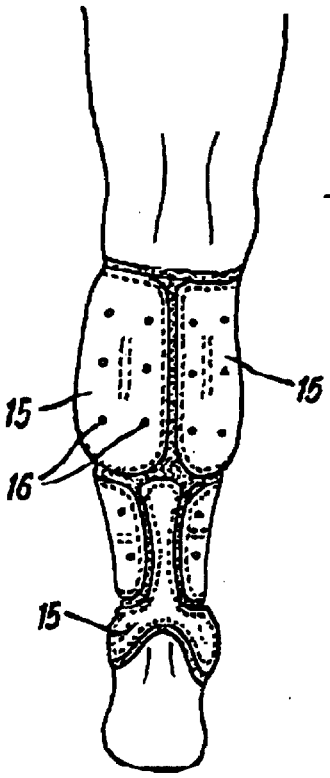
Figure 2C:
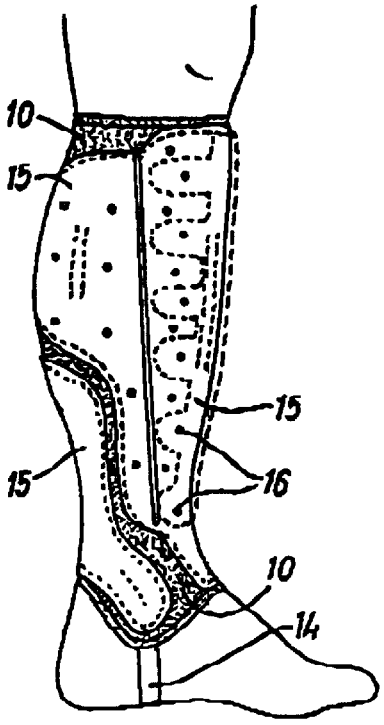

Referring now to FIGS. 2*a* to 2*c,* over the sock 10 there are stitched a number of panels 15 of high density synthetic foamed material which is impact absorbent and consists of specially shaped templates to protect designated areas of the leg without inhibiting movement. In particular, the calf muscle, shin bone, Achilles tendon and ankle bones are protected by this layer. Once again air holes 16 may be provided for ventilation. The foam panels are peripherally stitched to the inner sock. If required, a double layer of foam may be provided along the front of the appliance to give extra absorption in the area of the shin bone.

Figure 3A:
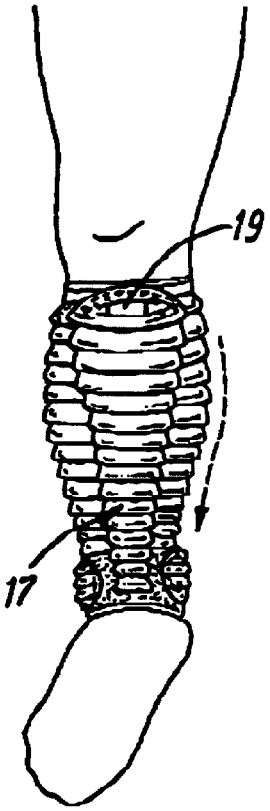
Figure 3B:
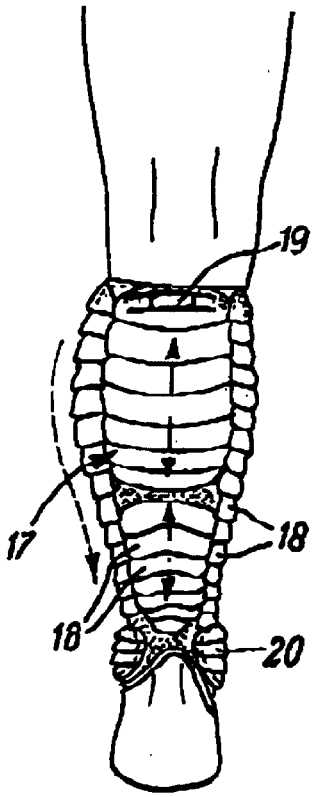
Figure 3C:
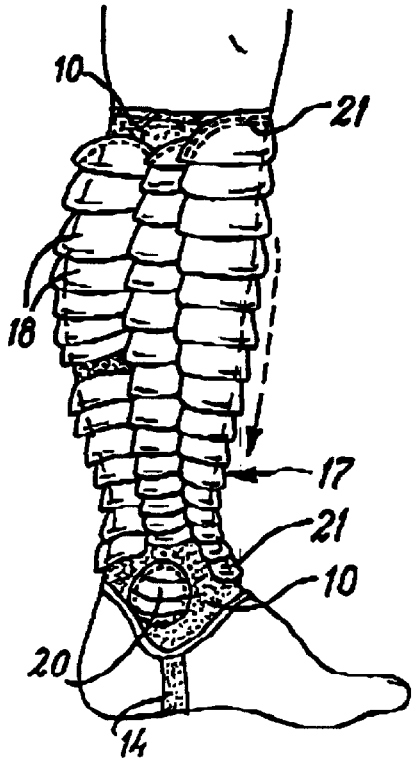
Figure 4:
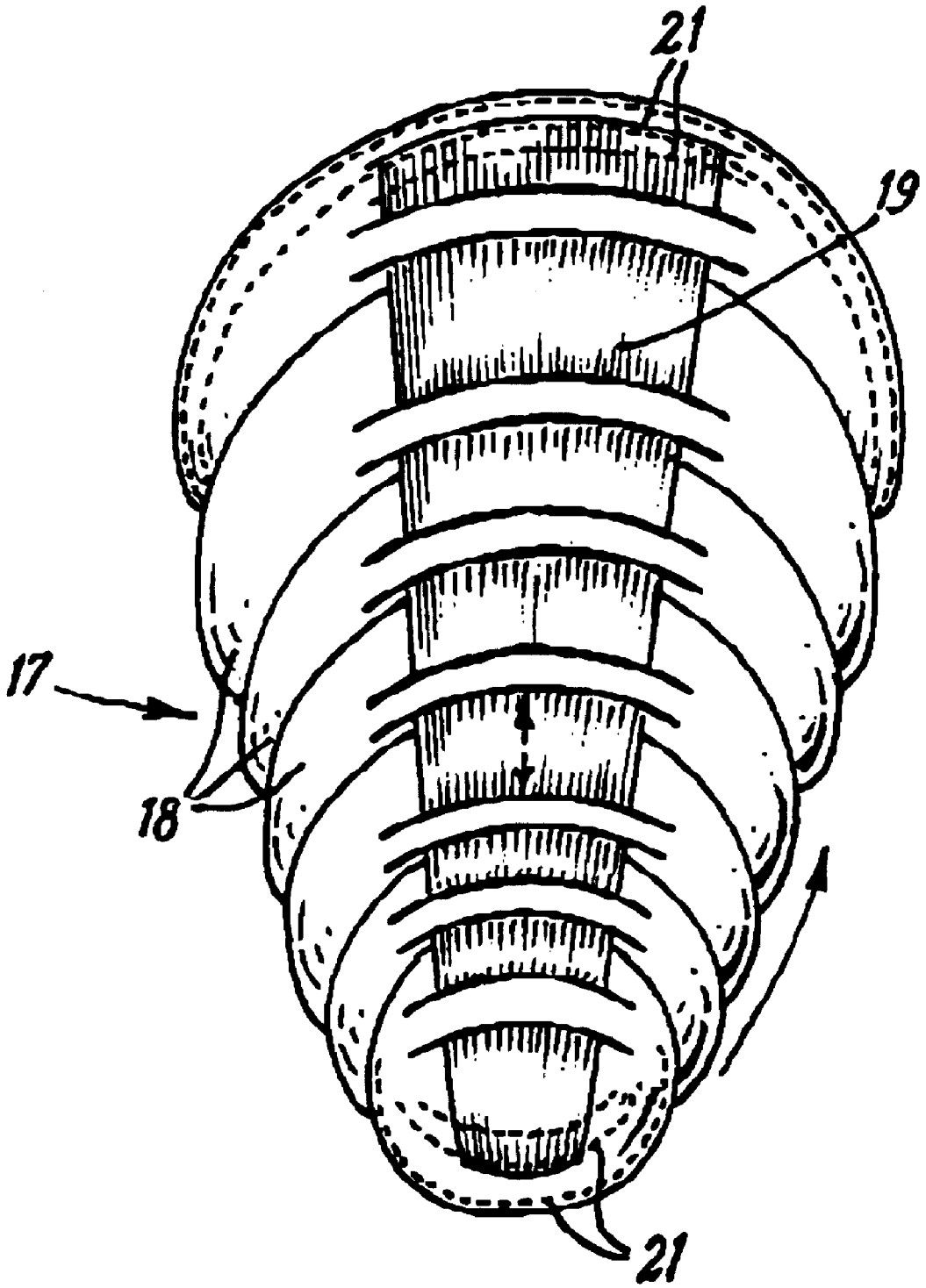
FIG. 4 is an internal view of an outer part of the appliance.

Referring now to FIGS. 3*a* to 3 *c* and FIG. 4, an outer protective layer is provided in the form of "stretch armour" and consists of a number of panels 17 each comprising a vertical column of overlapping rigid plates 18 of a high density polyethylene connected together by an inner central strip of elastic 19 for each panel 17.

Each such panel 17 of stretch armour and elastic strip 19, is stitched at its opposed ends, as shown at 21, to the inner sock 10.

The plates 18 of each panel, although overlapping and to some extent nesting together, are of progressively varying shape and dimensions throughout the length of the panel thus to conform to the shape of the limb. Thus, for example, the front panel 17 has plates which are wider at the top and gradually reduce in width down towards the ankle. The panels 17 overlap where appropriate to provide a complete shield around the lower leg leaving a space only where necessary to ensure complete freedom of movement.

Because the plates 18 of each panel 17 are interconnected in this way on the strip of elastic 19 which is connected only at upper and lower ends to the inner sock 19 and because they are able to slide relative to one another almost no inhibition of movement is created thereby whilst a highly protective impact shield is provided.

Owing to the overlapping configuration of the plates 18, the force of any impact is distributed throughout the associated panel 17 and thus dispersed over a large surface area with the effect of minimising localised bruising.

The ankle bones are protected also by a small panel 20 of interconnected rigid plates all stitched to the inner sock 10.

The inner sleeve 11 may be of continuous tubular form throughout its length, or alternatively, a plurality of longitudinally-spaced straps to be applied about the body to secure the rigid plates 18.

The entire appliance, because of its close conformity with the shape of the leg may be worn conveniently beneath, for example, a football sock and thus can be concealed thereby. Alternatively the appliance may be produced with an aesthetically pleasing appearance and in a number of colours as required to depict, for example, a particular sports club or the like. The device is lightweight, flexible and highly protective combining impact absorption, distribution and muscle support.

Whilst the above description and the drawings relate to such an appliance for the lower leg, conceivably a similar appliance may be adapted for use on any part of the body but particularly those parts most prone to impact injury.

Figure 5:
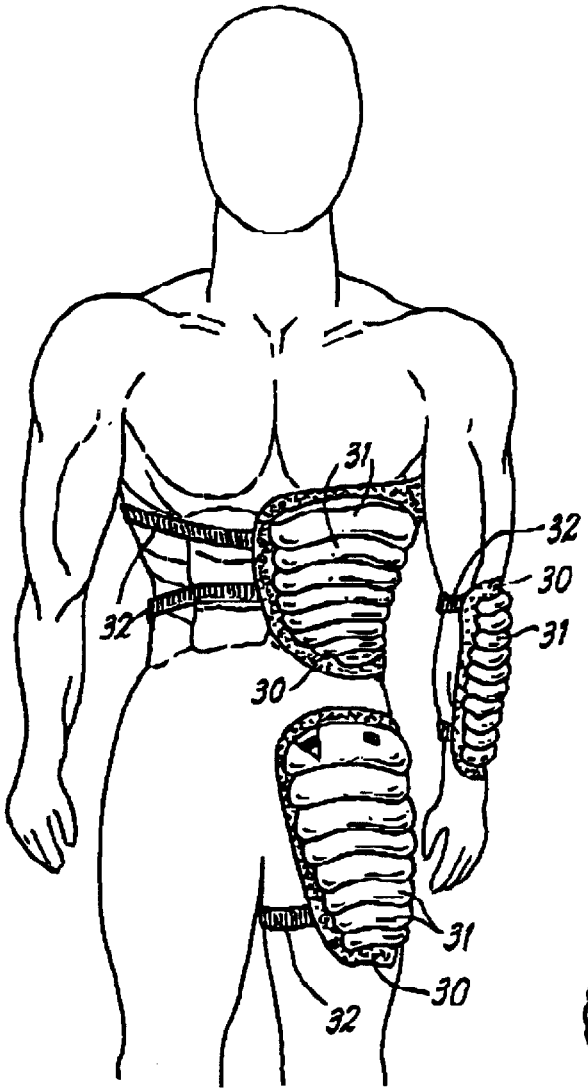
FIG. 5 illustrates in front views an appliance made in accordance with the invention and worn on the upper rub cage, thigh and forearm.
Figure 7:
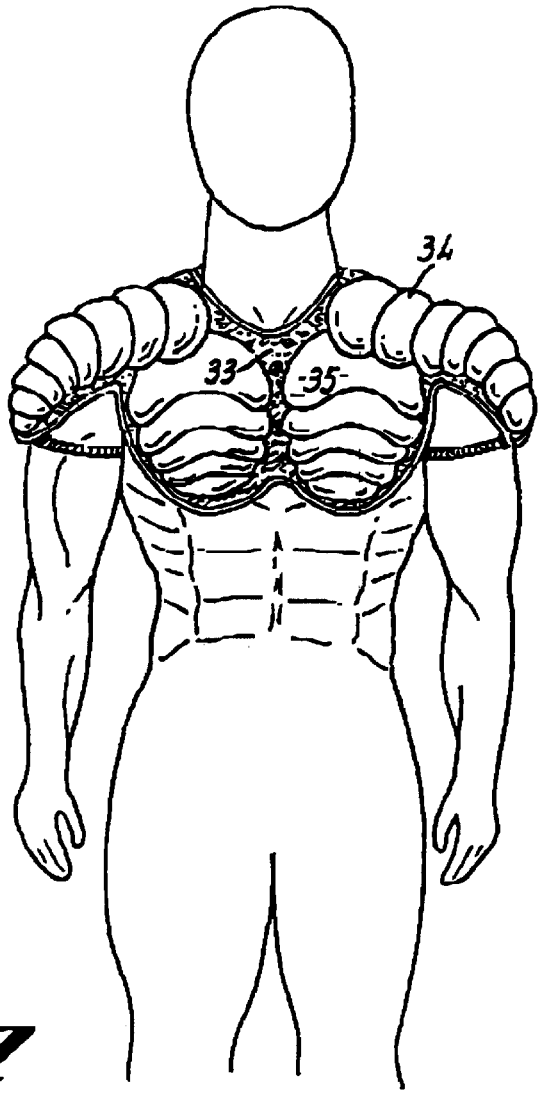
FIGS. 6 to 10 illustrate front and rear views collectively, of similar appliances worn on the upper body and shoulder regions.
Figure 6:
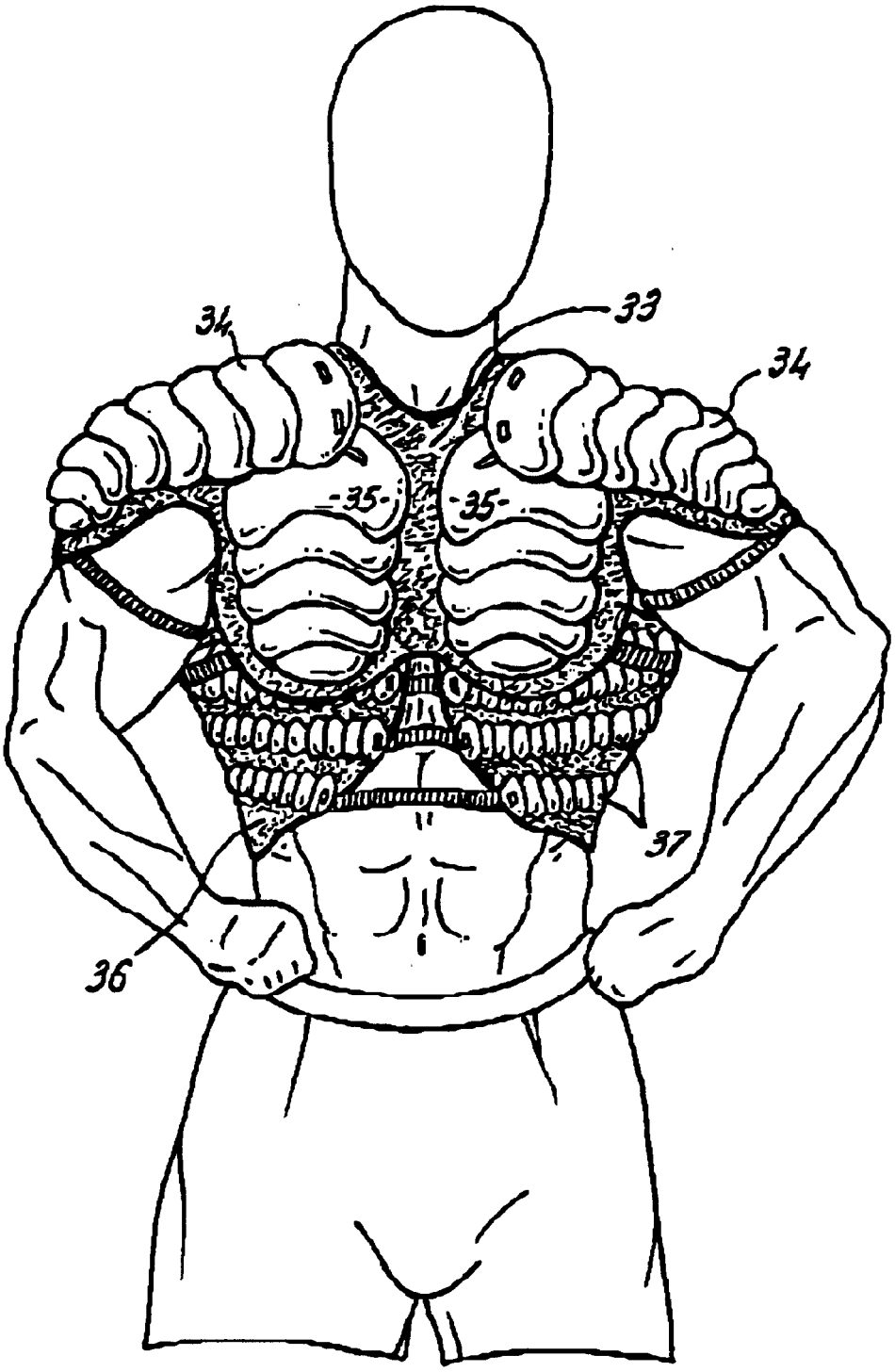
Figure 8:
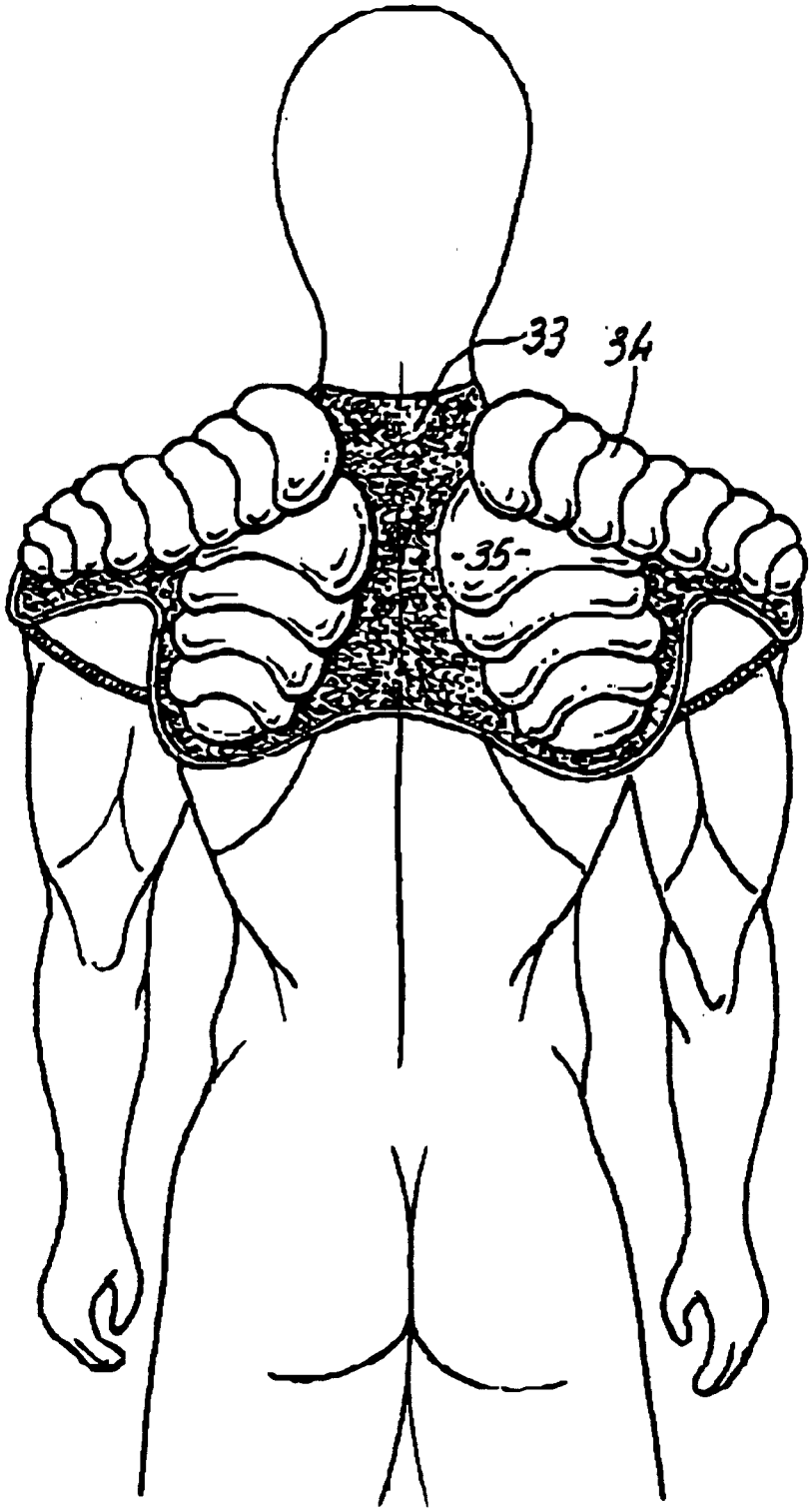
Figure 9:
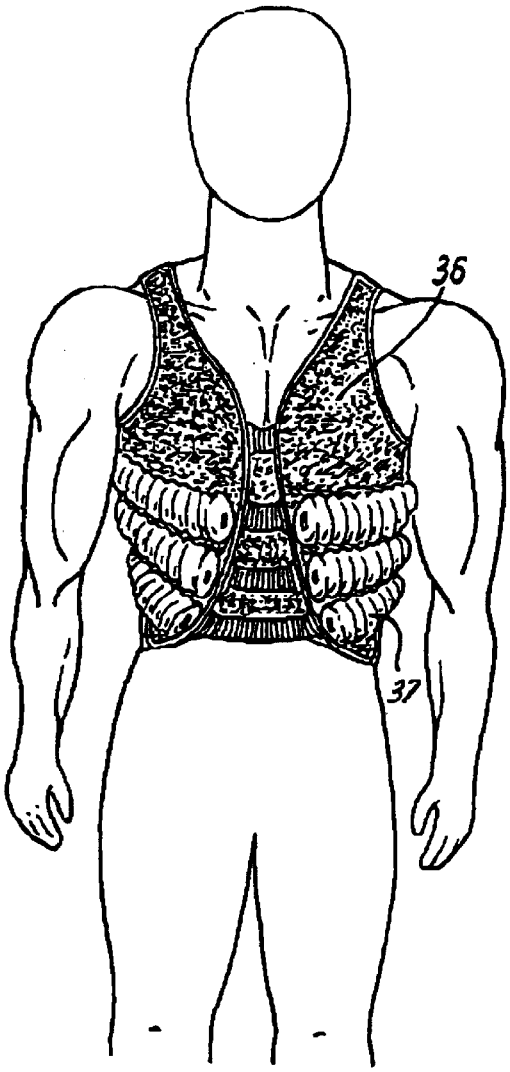
Figure 10:
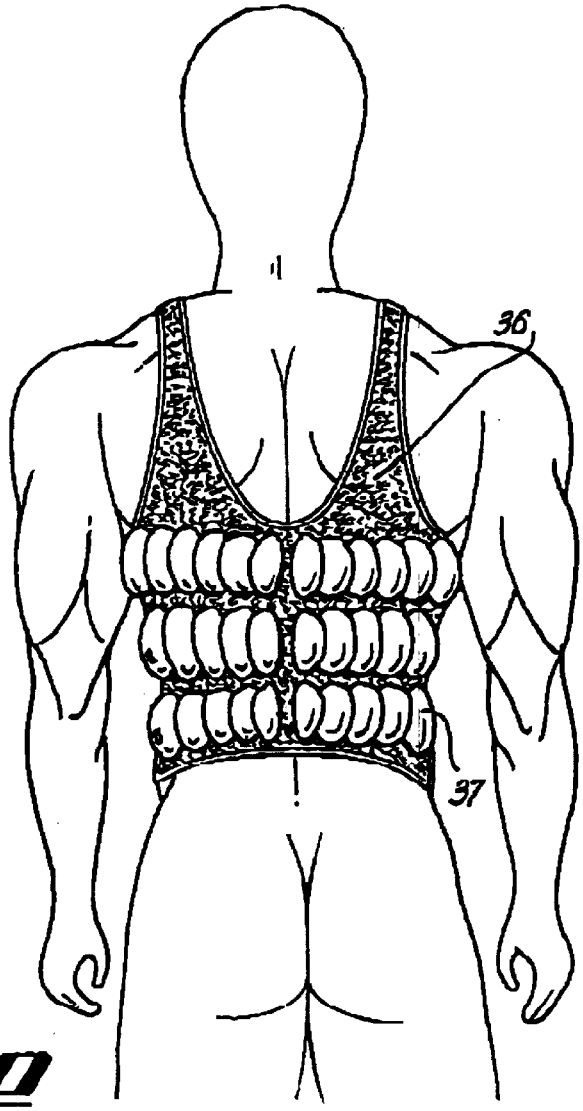

Thus, as can be seen in FIG. 5, similar devices may be tailored to be applied to the hip, forearm and rib cage of, for example, a cricket player. In this example each device comprises a base panel 30 and overlapping plates 31 maintained by elasticated straps 32.

FIGS. 6 to 10 illustrate similar devices tailored for protection of the rib cage and shoulder regions of the upper body. A yoke-like panel 33 has overlapping plates 34 and 35 to protect the shoulders, chest and back regions, while a bolero-like panel 36 has rows of overlapping plates 37 for protection of the rib cage and mid-to-lower back.

The devices illustrated in FIGS. 5 to 10 can be constructed in a manner similar to those illustrated in FIGS. 1 to 4.

Figure 11:
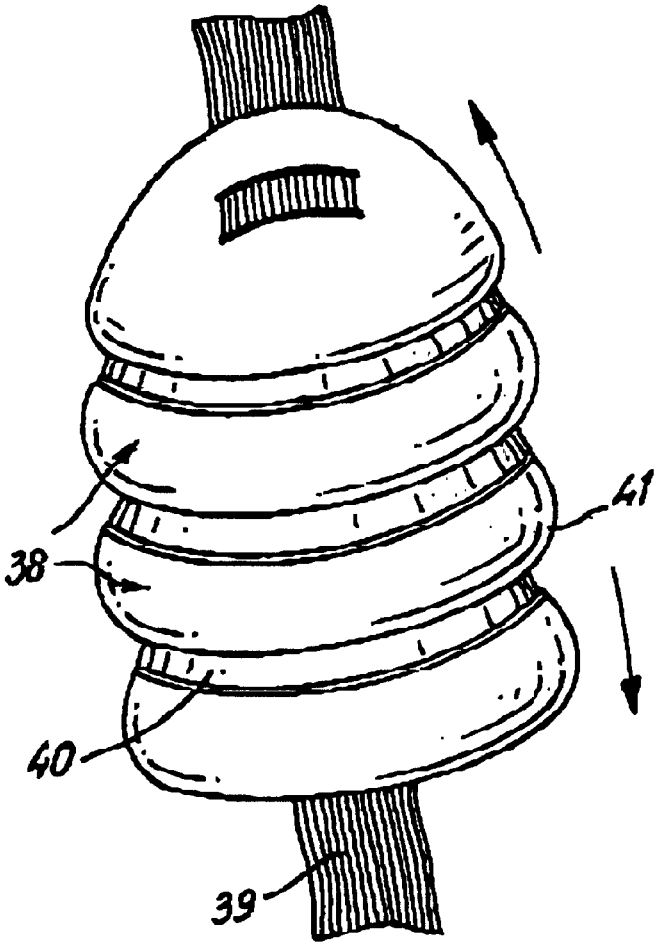
FIGS. 11 and 12 are front and cross-sectional views respectively of an appliance made in accordance with another embodiment.
Figure 12:
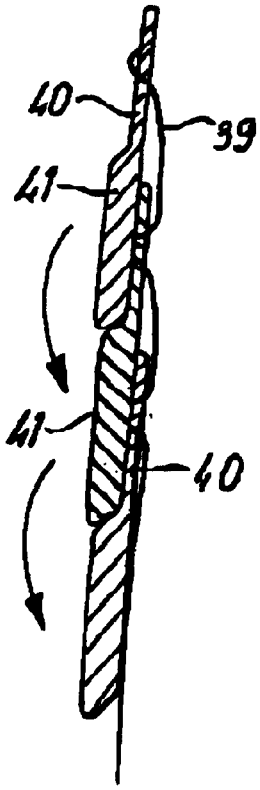

Referring now to FIGS. 11 and 12, in an alternative embodiment, a series of individual plates 38 are similarly maintained in overlapping relationship by an elastic strip 39. However, in this case, each plate 38 comprises a thin back plate portion 40 and a thicker frontal portion 41. As can be seen in FIG. 11, such plates are "nested" together such that the thin portion 40 of each plate sits behind the thicker portion 41 of the next upper plate 38, thus forming a closely interlocked series with maximised impact protection and flexibility. Also by this stepped configuration impact distribution along the device is ensured by direct contact between the aligned thicker portions 41.

Figure 13:
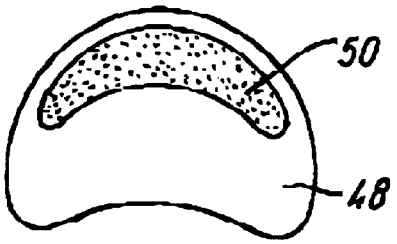
FIGS. 13 to 15 illustrate the construction on appliances made in accordance with a further embodiment.
Figure 14:
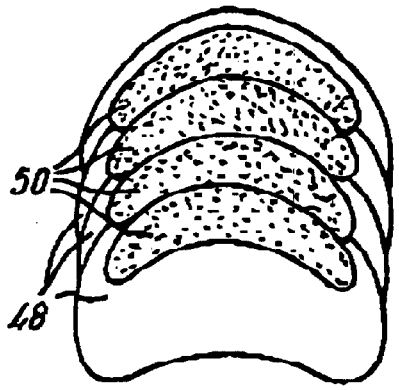
Figure 15:
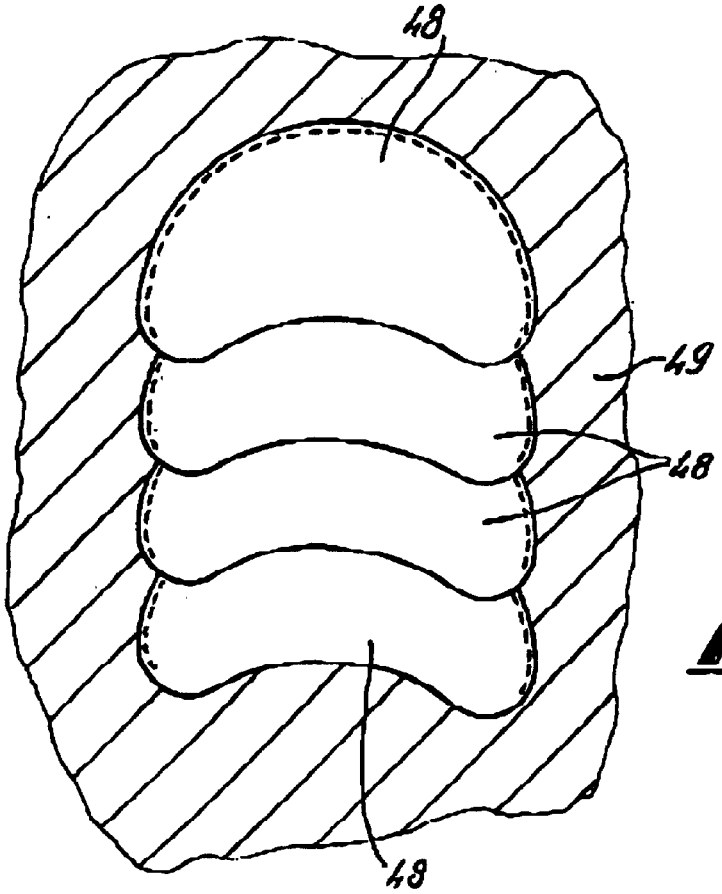

Referring now to FIGS. 13 to 15, an increased level of protection may be afforded within the overall concept by providing panels of overlapping plates 48, some or all of which may be individually attached to an under-sleeve or panel 49 or to a garment. Each plate 48 has its own individual back panel 50 of a dense foamed plastics absorption material preferably bonded to the rear face of the respective plate 48. In this regard FIG. 13 shows the rear of a single plate and FIG. 14 shows the rear of a series of such plates "nested " together, while FIG. 15 shows how the plates 48 may be individually stitched to the flexible panel 49.

What is claimed is:

1. An appliance for protection against impact and strain injury including a flexible panel adapted to be worn on a part of the body and to conform closely to the shape thereof, and a plurality of interconnected rigid plates carried by the panel such as to permit limited relative movement between the plates, the plates being connected together in overlapping relationship on a backing strip, at least some of said plates being movable relative to each other and to said backing strip.

2. An appliance according to claim 1, wherein the panel is of continuous tubular form throughout its length.

3. An appliance according to claim 1, wherein the panel comprises a plurality of straps to be applied about the body to secure the rigid plates.

4. An appliance according to claim 1, wherein the panel is part of an item of sports clothing.

5. An appliance according to claim 1, wherein the panel comprises an elasticated sock adapted to be worn about the lower leg and having outer interconnected rigid plates attached to the backing strip substantially throughout the length of the sock.

6. An appliance according to claim 5, including, between the sock and the rigid plates, a layer of impact absorbent foamed material.

7. An appliance according to claim 1, wherein the backing strip is an elastic strip.

8. An appliance according to claim 7, wherein the rigid plates are of a high density polyethylene and are individually shaped to match the contours of the part of the body on which the appliance is to be worn.

9. An appliance according to claim 7, wherein the overlapping plates are provided in several vertical columns to be worn about the front and rear regions of the lower leg, each column of plates being connected together by an inner central backing strip of elastic stitched at its upper and lower ends to the panel.

10. An appliance according to claim 1, wherein each rigid plate comprises a thin back plate portion and a thicker frontal portion, the plates being nested together such that the thin portion of each plate is superimposed behind the thicker portion of the next upper plate thus forming a closely interlocked series of plates in a stepped configuration.

11. An appliance according to claim 1, wherein at least some of the rigid plates are individually stitched directly to the panel.

12. An appliance according to claim 1, wherein each rigid plate includes an individual back panel of an absorption material attached to the rear face of the plate.

13. An appliance according to claim 1, wherein the overlapping plates progressively decrease in size along a longitudinal direction of the backing strip.

14. An appliance for protection against impact and strain injury, said appliance comprising:

a) a flexible base member for placement in overlying relationship with a portion of the body to be protected;

b) a plurality of substantially rigid plate elements having a curvature corresponding with that of the portion of the body over which the base member is positioned, wherein successive plate elements are disposed in partially overlapped, shingled relationship with each other; and c) an elongated elastic connecting carrier member for supporting the respective plates for relative lengthwise movement along the carrier member.

15. An appliance according to claim 14, wherein endmost plate elements are secured to the base member.

16. An appliance according to claim 15, wherein intermediate plate elements positioned between the endmost plate elements are each loosely carried by the carrier member, to allow the intermediate plate elements to move relative to each other both longitudinally along the carrier member and transversely relative to the carrier member.

17. An appliance according to claim 14, wherein the plate elements progressively decrease in size in a longitudinal direction of the carrier member.

18. An appliance according to claim 14, wherein the carrier member passes through portions of each of the plate elements to hold them in a predetermined spatial relationship to each other.

* * * * *